US011248625B2

(12) United States Patent
Mitsuhashi et al.

(10) Patent No.: US 11,248,625 B2
(45) Date of Patent: Feb. 15, 2022

(54) VACUUM PUMP, STATOR COLUMN USED THEREIN, AND METHOD FOR MANUFACTURING STATOR COLUMN

(71) Applicant: Edwards Japan Limited, Chiba (JP)

(72) Inventors: Keita Mitsuhashi, Chiba (JP); Tooru Miwata, Chiba (JP)

(73) Assignee: Edwards Japan Limited, Chiba (JP)

( * ) Notice: Subject to any disclaimer, the term of this patent is extended or adjusted under 35 U.S.C. 154(b) by 52 days.

(21) Appl. No.: 16/468,165

(22) PCT Filed: Dec. 8, 2017

(86) PCT No.: PCT/JP2017/044247

§ 371 (c)(1),
(2) Date: Jun. 10, 2019

(87) PCT Pub. No.: WO2018/110467

PCT Pub. Date: Jun. 21, 2018

(65) Prior Publication Data

US 2019/0383307 A1 Dec. 19, 2019

(30) Foreign Application Priority Data

Dec. 16, 2016 (JP) ..... JP2016-244002

(51) Int. Cl.
*F04D 29/52* (2006.01)
*F04D 19/04* (2006.01)

(52) U.S. Cl.
CPC ..... *F04D 29/522* (2013.01); *F04D 19/04* (2013.01); *F05D 2260/60* (2013.01)

(58) Field of Classification Search
CPC ..... F04D 19/04; F04D 19/042; F04D 29/023; F04D 29/522
See application file for complete search history.

(56) References Cited

U.S. PATENT DOCUMENTS 3,759,111 A * 9/1973 Hoff ..... F16H 55/563 474/14
4,631,092 A * 12/1986 Ruckle ..... C22F 1/183 148/421

(Continued)

FOREIGN PATENT DOCUMENTS

DE 102013219050 WO 1/2015
EP 1596068 A2 11/2005

(Continued)

OTHER PUBLICATIONS

European Communication dated Jun. 22, 2020 for corresponding European application Serial No. 17880111.4.

(Continued)

*Primary Examiner* — Patrick Hamo
(74) *Attorney, Agent, or Firm* — Theodore M. Magee; Westman, Champlin & Koehler, P.A.

(57) ABSTRACT

A vacuum pump includes a housing having an inlet port, a stator column provided upright inside the housing, a rotating body having a shape surrounding an outer periphery of the stator column, a support means for rotatably supporting the rotating body, and a driving means for driving the rotating body to rotate, wherein gas is sucked in from the inlet port by rotation of the rotating body, and the stator column is constituted of a cast material of aluminum alloy having a mechanical material property of an elongation of 5% or more.

8 Claims, 3 Drawing Sheets

(56) References Cited

U.S. PATENT DOCUMENTS

| | | | | |
|---|---|---|---|---|
| 10,240,608 | B2 * | 3/2019 | Schall | F04D 25/04 |
| 2010/0199495 | A1 * | 8/2010 | Holzer | C22C 21/14<br>29/889.23 |
| 2016/0222974 | A1 * | 8/2016 | Sakaguchi | F04D 29/023 |

FOREIGN PATENT DOCUMENTS

| | | | |
|---|---|---|---|
| JP | 2001059496 | A | 3/2001 |
| JP | 2005180265 | A | 7/2005 |
| JP | 2009535550 | A | 10/2009 |
| JP | 2015059426 | A | 3/2015 |
| WO | 2007125104 | A1 | 11/2007 |

OTHER PUBLICATIONS

PCT International Search Report dated Feb. 20, 2018 for corresponding PCT Application No. PCT/JP2017/044247.
PCT International Written Opinion dated Feb. 20, 2018 for corresponding PCT Application No. PCT/JP2017/044247.

* cited by examiner

VACUUM PUMP, STATOR COLUMN USED THEREIN, AND METHOD FOR MANUFACTURING STATOR COLUMN

CROSS-REFERENCE OF RELATED APPLICATION

This application is a Section 371 National Stage Application of International Application No. PCT/JP2017/044,247, filed Dec. 8, 2017, which is incorporated by reference in its entirety and published as WO 2018/110,467A1 on Jun. 21, 2018 and which claims priority of Japanese Application No. 2016-244,002, filed Dec. 16, 2016.

BACKGROUND

The present invention relates to a vacuum pump used as a gas exhaust means for a process chamber or other enclosed chamber of a semiconductor manufacturing apparatus, a flat panel display manufacturing apparatus, and a solar panel manufacturing apparatus, a stator column used in the vacuum pump, and a method for manufacturing the stator column.

As this type of vacuum pump, there has conventionally been known a turbomolecular pump described in Japanese Patent Application Laid-open No. 2001-59496. As shown in FIG. 1 of Japanese Patent Application Laid-open No. 2001-59496, the vacuum pump (turbomolecular pump) described in Japanese Patent Application Laid-open No. 2001-59496 includes, as specific pump components thereof, a housing (14) having an inlet port (14*a*), a stator column (16) provided upright inside the housing (14), a rotating body (R) having a shape surrounding an outer periphery of the stator column (16), supporting means (20, 22) for rotatably supporting the rotating body (R), and a driving means (18) for driving the rotating body (R) to rotate, wherein gas is sucked in from the inlet port (14*a*) by rotation of the rotating body (R).

Incidentally, in the vacuum pump (turbomolecular pump) described in Japanese Patent Application Laid-open No. 2001-59496, a scattering prevention member 50 is provided on the inlet port (14*a*) as a means for preventing broken pieces of the rotating body (R) from flying out of the inlet port (14*a*) (see paragraph 0007 and abstract of Japanese Patent Application Laid-open No. 2001-59496).

Also, in this conventional vacuum pump, it is expected that, for example, fracture energy of the rotating body (R) cause the stator column (16) to crack and consequently broken pieces resulting from the destruction of the stator column (16) (specifically, fragments of the stator column (16) or a mass containing fragments of electrical components such as the motor (18) attached to the stator column (16) and of the stator column (16)) fly out of the inlet port (14*a*), but scattering of such broken pieces might also be able to be prevented by the scattering prevention member 50 described above.

However, the problems with such a configuration of the conventional vacuum pump (turbomolecular pump) in which the scattering prevention member 50 is provided on the inlet port (14*a*) include an increase in the number of components of the vacuum pump due to the presence of the scattering prevention member 50 and a degradation of the exhaust performance of the vacuum pump (turbomolecular pump) itself due to a decrease in the aperture area of the inlet port (14*a*) caused by providing the scattering prevention member 50.

In the foregoing description, the reference numerals in the parenthesis represent reference numerals used in Japanese Patent Application Laid-open No. 2001-59496

The discussion above is merely provided for general background information and is not intended to be used as an aid in determining the scope of the claimed subject matter. The claimed subject matter is not limited to implementations that solve any or all disadvantages noted in the background.

SUMMARY

The present invention was contrived in view of the problems mentioned above, and an object thereof is to provide a highly reliable vacuum pump that is suitable for preventing such problems as cracking of a stator column caused by fracture energy of a rotating body, as well as scattering of broken pieces resulting from the destruction of the stator column from an inlet port, without degrading the exhaust performance of the vacuum pump or increasing the number of components of the vacuum pump, the stator column used in this vacuum pump, and a method for manufacturing the stator column.

Manufacturing a stator column from a wrought material that is more ductile than a cast material generally leads to an increase in the cost of materials, hence a higher cost of an entire vacuum pump. It is therefore desirable to manufacture the stator column from a cast material that is inexpensive and has approximately the same levels of strength and elongation (ductility) as a wrought material.

In order to achieve the foregoing object, the present invention provides a vacuum pump that includes a housing having an inlet port, a stator column provided upright inside the housing, a rotating body having a shape surrounding an outer periphery of the stator column, a supporting means for rotatably supporting the rotating body, and a driving means for driving the rotating body to rotate, wherein gas is sucked in from the inlet port by rotation of the rotating body, and the stator column is constituted of a cast material of aluminum alloy having a mechanical material property of an elongation of 5% or more.

The present invention also provides a method for manufacturing a stator column used in a vacuum pump, the method including a casting step of manufacturing the stator column by casting using an aluminum alloy in which a ductility reinforcement treatment is performed for imparting a mechanical material property of an elongation of 5% or more to the stator column.

In the present invention, the ductility reinforcement treatment may include a process of adding an additive to the aluminum alloy.

In the present invention, the ductility reinforcement treatment may include a heat treatment performed on the stator column.

In the present invention, the additive may contain boron or titanium.

In the present invention, the additive may contain both boron and titanium.

In the present invention, the heat treatment may include a solution treatment including heating at a first temperature higher than a normal temperature including a predetermined time, a first aging heat treatment including cooling at the normal temperature for a predetermined time immediately after completion of the solution treatment, and a second aging heat treatment including heating at a temperature lower than the first temperature for a predetermined time immediately after completion of the first aging heat treatment.

According to the present invention, as a specific configuration of the stator column used in the vacuum pump, the stator column is constituted of a cast material of aluminum alloy having an elongation of 5% or more. Therefore, the cost of manufacturing the stator column can be reduced. Even if fracture energy of the rotating body acts on the stator column, the fracture energy can adequately be absorbed by the elongation of the stator column, thereby preventing such problems as cracking of the stator column caused by the fracture energy, and scattering of broken pieces resulting from the destruction of the stator column from the inlet port. In addition, unlike the prior art, the scattering prevention member does not need to be disposed on the inlet port as a means for preventing these problems. Therefore, the present invention can provide a highly reliable vacuum pump suitable for preventing these problems without degrading the exhaust performance of the vacuum pump or increasing the number of components of the vacuum pump, a stator column used in such a vacuum pump, and a method for manufacturing the stator column.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DESCRIPTION OF THE PREFERRED EMBODIMENTS

The best mode for carrying out the present invention is now described hereinafter in detail with reference to the accompanying drawings.

Figure 1:
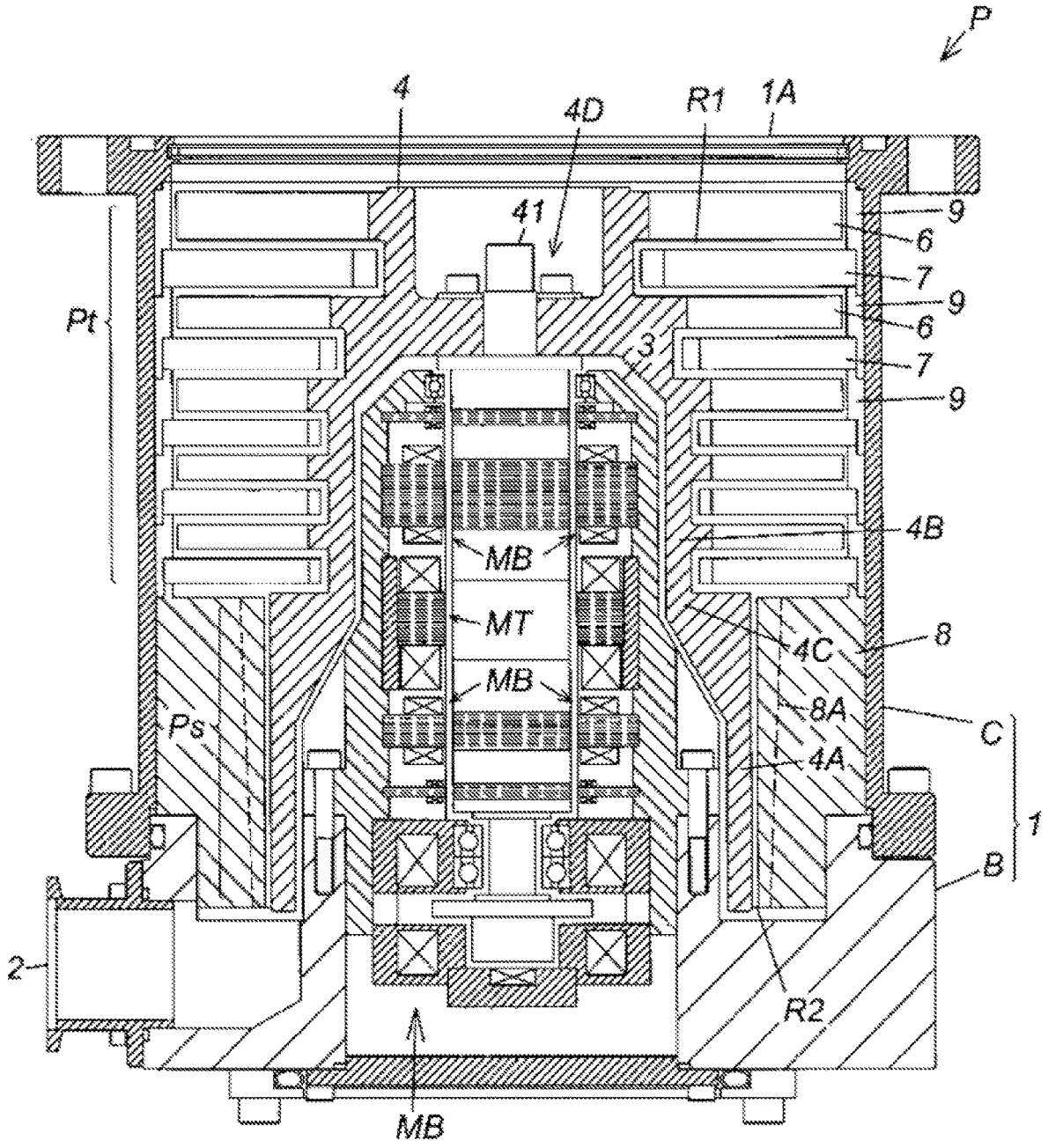
FIG. 1 is a cross-sectional view of a vacuum pump to which the present invention is applied.

FIG. 1 is a cross-sectional view of a vacuum pump to which the present invention is applied.

A vacuum pump P shown in FIG. 1 is a compound pump having a turbomolecular pump mechanism portion Pt and a thread groove pump mechanism portion Ps as gas exhaust mechanisms and used as a gas exhaust means and the like of a process chamber or other enclosed chamber of, for example, a semiconductor manufacturing apparatus, a flat panel display manufacturing apparatus, and a solar panel manufacturing apparatus.

In the vacuum pump P shown in FIG. 1, a housing 1 is in a substantially cylindrical shape having a bottom by integrally connecting a cylindrical pump case C and a pump base B in a cylinder axial direction using a fastening member.

An upper end portion of the pump case C (the upper side of the drawing in FIG. 1) is opened as an inlet port 1A, and an outlet port 2 is provided in the pump base B. Specifically, the housing 1 includes the inlet port 1A and the outlet port 2. Although not shown, the inlet port 1A is connected to an enclosed chamber, not shown, which becomes high vacuum, such as a process chamber of a semiconductor manufacturing apparatus, while the outlet port 2 is communicated with an auxiliary pump, also not shown.

A stator column 3 is provided upright inside the housing 1. In particular, in the vacuum pump P shown in FIG. 1, the stator column 3 is located at a central portion of the pump case C and provided upright on the pump base B; however, the structure of the stator column 3 is not limited thereto.

A rotating body 4 is provided outside the stator column 3. Various electrical components are embedded in the stator column 3, including a magnetic bearing MB as a supporting means for supporting the rotating body 4 in radial and axial directions thereof, and a drive motor MT as a driving means for driving the rotating body 4 to rotate. Since the magnetic bearing MB and the drive motor MT are well-known electrical components, detailed descriptions of the specific configurations of said electrical components are omitted.

The rotating body 4 has a shape surrounding an outer periphery of the stator column 3, is disposed rotatably on the pump base B, and is enclosed in the pump base B and the pump case C.

In the vacuum pump P shown in FIG. 1, the rotating body 4 has a structure in which two cylindrical bodies having different diameters (a first cylindrical body 4A constituting the thread groove pump mechanism portion Ps and a second cylindrical body 4B constituting the turbomolecular pump mechanism portion Pt) are coupled to each other in a cylinder axial direction by a coupling portion 4C, a structure having a fastening portion 4D for fastening the second cylindrical body 4B and a rotating shaft 41 described hereinafter to each other, and a structure in which a plurality of moving blades 6 described hereinafter am arranged in multiple stages on an outer peripheral surface of the second cylindrical body 4B, are employed as specific structures of the rotating body 4. However, the structure of the rotating body 4 is not limited thereto.

The rotating shaft 41 is provided inside the rotating body 4. The rotating shaft 41 is located inside the stator column 3 and fastened integrally to the rotating body 4 via the fastening portion 4D. The rotating body 4 is configured to be rotatably supported at a predetermined position in the axial and radial directions thereof by supporting the rotating shaft 41 using the magnetic bearing MB, and the rotating body 4 is configured to be driven to rotate around a rotation center thereof (specifically, around the rotating shaft 41) by rotating the rotating shaft 41 using the drive motor MT. The rotating body 4 may be supported and driven to rotate using a different structure.

The vacuum pump P shown in FIG. 1 has gas flow paths R1, R2 as means for sucking gas in from the inlet port 1A by rotation of the rotating body 4 and exhausting the gas from the outlet port 2 to the outside.

According to an embodiment of the gas flow paths R1, R2, in the vacuum pump P shown in FIG. 1, of the whole gas flow paths R1, R2, the first half, inlet-side gas flow path R1 (the upstream side of the coupling portion 4C of the rotating body 4) is configured by the plurality of moving blades 6 provided on the outer peripheral surface of the rotating body 4 and a plurality of stationary blades 7 fixed to an inner peripheral surface of the pump case C via spacers 9, and the latter half, outlet-side gas flow path R2 (the downstream side of the coupling portion 4C of the rotating body 4) is configured as a thread groove-like flow path by the outer peripheral surface of the rotating body 4 (specifically, an outer peripheral surface of the first cylindrical body 4A) and a thread groove pump stator 8 opposed to the outer peripheral surface of the rotating body 4.

The configuration of the inlet-side gas flow path R1 is described in more detail. In the vacuum pump P shown in FIG. 1, the plurality of moving blades 6 are arranged radially around a pump axial center (e.g., the rotation center of the rotating body 4, etc.). The plurality stationary blades 7, on the other hand, are fixed to the inner periphery of the pump case C so as to be positioned in a pump radial direction and a pump axial direction via the spacers 9, and are arranged radially around the pump axial center.

In the vacuum pump P shown in FIG. 1, the moving blades 6 and the stationary blades 7 that are arranged radially as described above configure the inlet-side gas flow path R1 by being arranged alternately in multiple stages along the direction of the pump axial center.

In the inlet-side gas flow path R1 having the aforementioned configuration, the rotating body 4 and the plurality of moving blades 6 are rotated integrally at high speed by the activation of the drive motor MT. As a result, the moving blades 6 impart a downward momentum to gas molecules that have entered into the pump case C from the inlet port 1A. The gas molecules having the downward momentum are sent by the stationary blades 7 to the moving blades 6 of the next stage. The step of imparting a momentum to gas molecules and the step of feeding such gas molecules are repeated through the multiple stages, whereby the gas molecules present on the inlet port 1A side are exhausted in such a manner as to sequentially shift toward the outlet-side gas flow path R2 through the inlet-side gas flow path R1.

Next, the configuration of the outlet-side gas flow path R2 is described in further detail. In the vacuum pump P shown in FIG. 1, the thread groove pump stator 8 is an annular fixing member surrounding a downstream-side outer peripheral surface of the rotating body 4 (specifically, the outer peripheral surface of the first cylindrical body 4A. The same is true hereinafter), and is disposed in such a manner that an inner peripheral surface thereof is opposed to the downstream-side outer peripheral surface of the rotating body 4 (specifically, the outer peripheral surface of the first cylindrical body 4A) via a predetermined gap therebetween.

Furthermore, a thread groove 8A is formed in an inner peripheral portion of the thread groove pump stator 8. The thread groove 8A has a cone shape in which the depth of the thread groove 8A is reduced toward the bottom of the thread groove pump stator 8, and is engraved in a spiral shape from an upper end of the thread groove pump stator 8 to a lower end of the same.

In the vacuum pump P shown in FIG. 1, the downstream-side outer peripheral surface of the rotating body 4 and the inner peripheral portion of the thread groove pump stator 8 being opposed to each other configure the outlet-side gas flow path R2 as a thread groove-like gas flow path. Another embodiment can employ a configuration in which the outlet-side gas flow path R2 described above is formed by, for example, providing the thread groove 8A on the downstream-side outer peripheral surface of the rotating body 4.

In the outlet-side gas flow path R2 having the foregoing configuration, when the rotating body 4 is rotated by the activation of the drive motor MT, the gas flows from the inlet-side gas flow path R1 and is exhausted in such a manner as to shift while being compressed from a transitional flow to a viscous flow by a drag effect between the thread groove 8A and the downstream-side outer peripheral surface of the rotating body 4.

Constituent Materials of Stator Column

The stator column 3 described above is constituted of a cast material of aluminum alloy having an elongation equivalent or greater than that of a conventional stator column as a mechanical material property. Specifically, the stator column 3 is constituted of a cast material of aluminum alloy having an elongation of 5% or more (preferably 8% or more). The stator column 3 constituted of a cast material having such level of elongation can be manufactured by casting, and a method for manufacturing the stator column 3 executes the following<<ductility reinforcement treatment>> in the casting step of manufacturing the stator column 3 by casting using an aluminum alloy.

Figure 2:
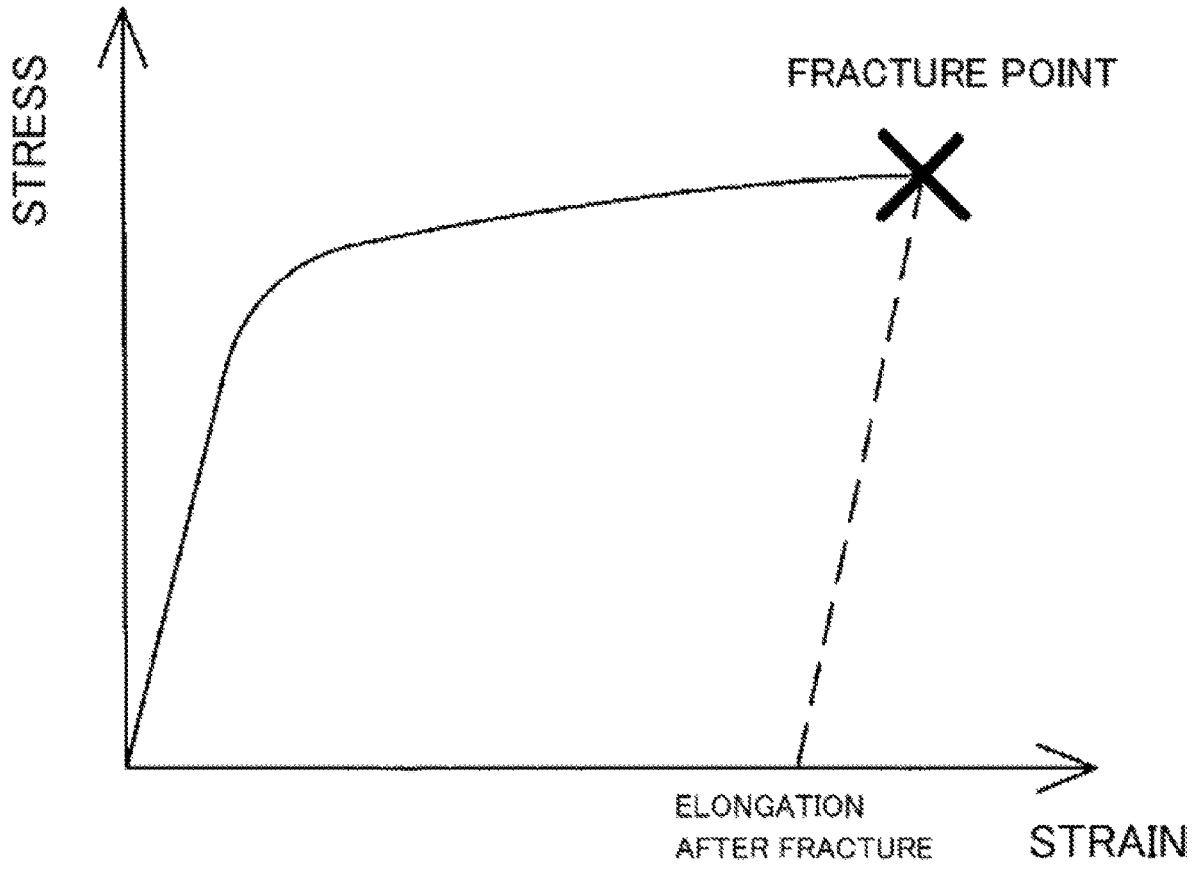
FIG. 2 is a stress-strain diagram of a cast material of aluminum alloy.

The term "elongation" refers to a ratio between the length of a test piece made of metal (aluminum alloy in the present embodiment) when fractured (see the fracture point shown in FIG. 2) when being pulled by a tensile tester, and the original length of the test piece. Specifically, when the original length of the test piece is represented as L and the length of the test piece when fractured is represented as L+ΔL, the term "elongation" is a numerical value representing ΔL/L in %.

Ductility Reinforcement Treatment

The ductility reinforcement treatment is divided roughly into two steps: an addition process for adding an additive to the aluminum alloy, and a heat treatment performed on the stator column 3. The experiment conducted by the inventors of the present invention has discovered that performing the two steps (the addition process and the heat treatment) together promotes metal crystal refinement of the aluminum alloy, thereby achieving the aforementioned elongation. It is possible that the aforementioned elongation can be achieved by performing either one of the steps, in which case the other step may be omitted.

Although boron and titanium is employed as the additive, substances used as the additive are not limited thereto. While either boron or titanium can be used, a substance other than boron and titanium can be used together with boron or titanium, or a substance other than boron and titanium can be used as the additive. In addition, the amount of the additive can be adjusted as needed.

Figure 3:
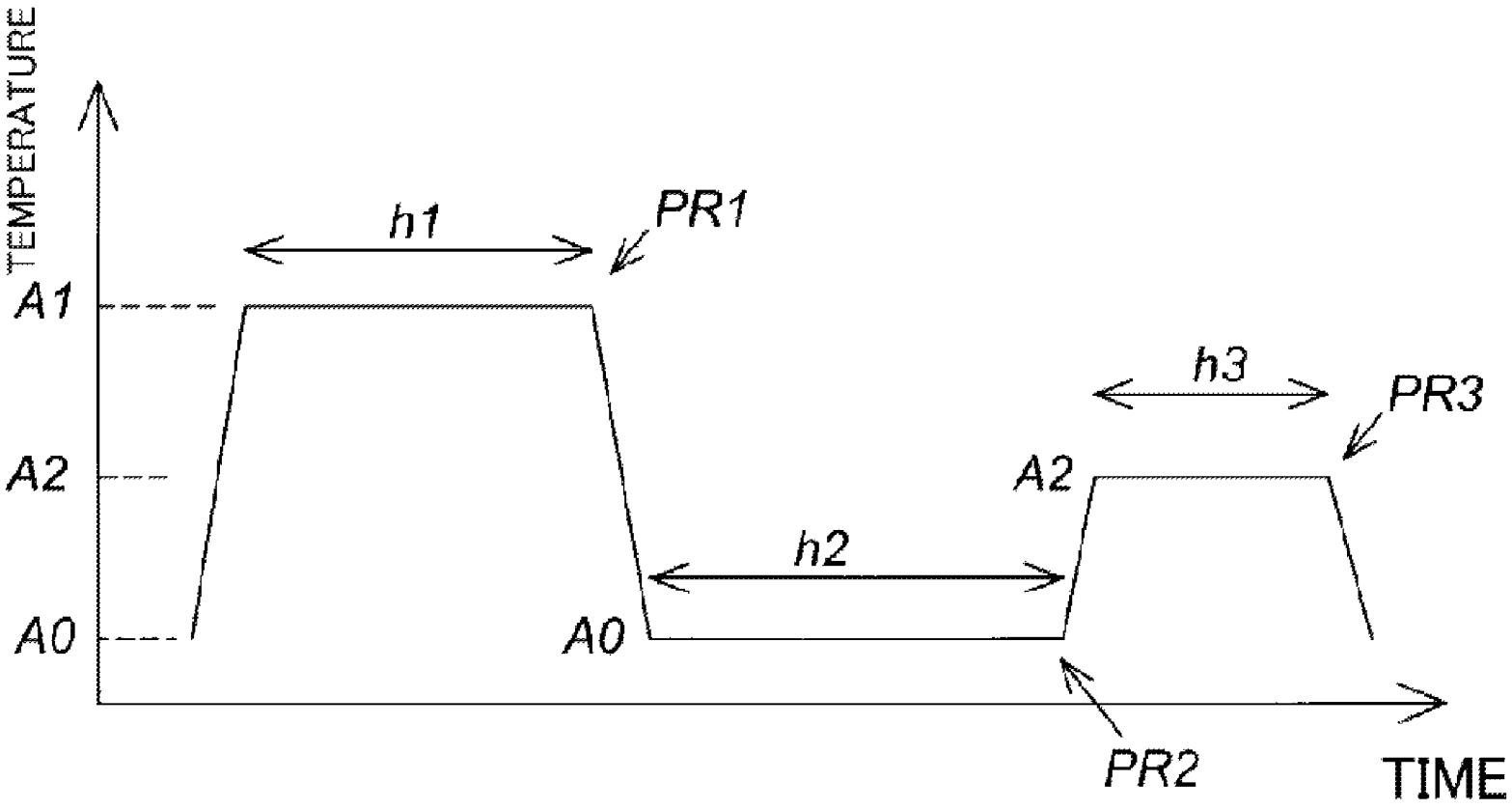
FIG. 3 is an explanatory diagram of a heat treatment according to the present invention.

As shown in FIG. 3, the heat treatment carries out a solution treatment PR1 including heating at a first temperature A1 higher than a normal temperature A0 for a predetermined time h1, a first aging heat treatment (normal temperature aging) PR2 including cooling at the normal temperature A0 for a predetermined time h2 immediately after completion of the solution treatment PR1, and a second aging heat treatment (artificial aging) PR3 including heating at a temperature lower than the first temperature A1 for a predetermined time T3 immediately after completion of the first aging heat treatment PR2. However, the heat treatment is not limited to these treatments and can therefore adopt different heat treatments.

According to the present embodiment described above, as a specific configuration of the stator column 3 used in the vacuum pump P, the stator column 3 is constituted of a cast material of aluminum alloy having an elongation of 5% or more. Thus, even if fracture energy of the rotating body 4 acts on the stator column 3, the fracture energy can adequately be absorbed by the elongation of the stator column 3, preventing such problems as cracking of the stator column 3 caused by the fracture energy, and scattering of broken pieces resulting from the destruction of the stator column 3 (e.g., fragments of the stator column 3 or a mass containing fragments of electrical components such as the motor MT and of the stator column 3) from the inlet port 1A. In addition, unlike the prior art, the present embodiment does not need to dispose the scattering prevention member at the inlet port to prevent these problems. In view of these facts, the present embodiment can realize the highly reliable vacuum pump P that is suitable for preventing these problems without degrading the exhaust performance of the vacuum pump or increasing the cost or the number of components of the vacuum pump.

The present invention is not limited to the embodiments described above, and many modifications can be made by those skilled in the art within the technical concept of the present invention.

Although elements have been shown or described as separate embodiments above, portions of each embodiment may be combined with all or part of other embodiments described above. Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump, comprising:

a housing having an inlet port;

a stator column provided upright inside the housing;

a rotating body having a shape surrounding an outer periphery of the stator column;

a supporting means for rotatably supporting the rotating body; and a driving means for driving the rotating body to rotate, the vacuum pump sucking gas in from the inlet port by rotation of the rotating body, wherein the stator column is constituted of a cast material of aluminum alloy having a mechanical material property of an elongation of 5% or more such that the stator column protects the driving means from broken pieces of the rotating body when the rotating body breaks apart while rotating in the housing.

2. A method for manufacturing a stator column used in a vacuum pump providing a rotating body, wherein the method comprises a casting step of manufacturing the stator column by casting using an aluminum alloy in which a ductility reinforcement treatment is performed for imparting a mechanical material property of an elongation of 5% or more to the stator column in order to protect a motor within the stator column when the rotating body breaks apart while rotating in the vacuum pump.

3. The method for manufacturing a stator column used in a vacuum pump according to claim 2, wherein the ductility reinforcement treatment includes a process of adding an additive to the aluminum alloy.

4. The method for manufacturing a stator column used in a vacuum pump according to claim 2, wherein the ductility reinforcement treatment includes a heat treatment performed on the stator column.

5. The method for manufacturing a stator column used in a vacuum pump according to claim 3, wherein the additive contains boron or titanium.

6. The method for manufacturing a stator column used in a vacuum pump according to claim 3, wherein the additive contains both boron and titanium.

7. The method for manufacturing a stator column used in a vacuum pump according to claim 4, wherein the heat treatment comprises a solution treatment including heating at a first temperature higher than a normal temperature for a predetermined time, a first aging heat treatment including cooling at the normal temperature for a predetermined time immediately after completion of the solution treatment, and a second aging heat treatment including heating at a temperature lower than the first temperature for a predetermined time immediately after completion of the first aging heat treatment.

8. A stator column which is used in a vacuum pump, the vacuum pump comprising:

a housing having an inlet port wherein the stator column is provided upright inside the housing;

a rotating body having a shape surrounding an outer periphery of the stator column;

a supporting means for rotatably supporting the rotating body; and a driving means within the stator column for driving the rotating body to rotate, the vacuum pump sucking gas in from the inlet port by rotation of the rotating body, wherein the stator column is constituted of a cast material of aluminum alloy having a mechanical material property of an elongation of at least 5% and the stator column protects the driving means from parts of the rotating body that break apart while the rotating body is rotating in the housing.

* * * * *